US005535988A

United States Patent [19]

Nishimura

[11] Patent Number: 5,535,988

[45] Date of Patent: Jul. 16, 1996

[54] LEVER TYPE HOIST HAVING REVERSE ROTATION PREVENTIVE MECHANISM

[75] Inventor: Yosaku Nishimura, Hirakata, Japan

[73] Assignee: Vital Kogyo Kabushiki Kaisha, Osaka, Japan

[21] Appl. No.: 186,864

[22] Filed: Jan. 27, 1994

[30] Foreign Application Priority Data

Feb. 17, 1993 [JP] Japan ..... 5-053051
May 14, 1993 [JP] Japan ..... 5-136567

[51] Int. Cl.[6] ..... B66D 1/14

[52] U.S. Cl. ..... 254/352; 254/372; 254/368

[58] Field of Search ..... 254/352, 366, 254/368, 369, 372; 192/93 A, 95

[56] References Cited

U.S. PATENT DOCUMENTS 4,420,144 12/1983 Nishimura .
4,768,754 9/1988 Nishimura ..... 254/352 X
5,156,377 10/1992 Nishimura ..... 254/352 X
5,364,073 11/1994 Sell ..... 254/366 X

FOREIGN PATENT DOCUMENTS

3323110C2 5/1984 Germany .
63-16714 5/1988 Japan .

*Primary Examiner*—Daniel P. Stodola
*Assistant Examiner*—Emmanuel M. Marcelo
*Attorney, Agent, or Firm*—Popham, Haik, Schnobrich & Kaufman, Ltd.

[57] ABSTRACT

If the load applied on the load sheave is small, the pressing drive member contacts tightly with the friction members to make secure the braking of rotation of the drive shaft, so that the small load is prevented from moving downward by its own gravity, and moreover the operation wheel is engaged with and held in the rotation limiting member spline-coupled with the drive shaft so as to be free to idle even in a no-load state, and a spring for pressing the operation wheel to the rotation limiting member is inserted between the outer end surface of the operation wheel and the spring retainer held on the drive shaft projecting from the rotation limiting member.

14 Claims, 21 Drawing Sheets

LEVER TYPE HOIST HAVING REVERSE ROTATION PREVENTIVE MECHANISM

BACKGROUND OF THE INVENTION

1. Field of the Invention

The present invention relates to a lever type hoist, and more particularly to a lever type hoist equipped with a reverse rotation preventive mechanism when a load is applied to a load sheave, and capable of idling the load sheave in order to adjust the position of a lower hook in no-load state.

2. Description of the Related Art

An example of the structure of a conventional lever type hoist is shown in FIG. 27. This lever type hoist mainly comprises a drive shaft 101, a pressure bearing member 108, a reverse rotation preventive wheel 105, a pressing drive member 108, a spring 109, a rotation limiting member 110, and an operation wheel 111. The pressure bearing member 103 is driven into the innermost side (the left side in the drawing) of a threaded part 102 of the drive shaft 101. The reverse rotation preventive wheel 105 is interposed between friction members 106, 106, and the reverse rotation preventive wheel 105 and the friction members 106 are rotatably fitted on the outer circumference of a boss part 104 of the pressure bearing member 103. The pressing drive member 108 is screwed into the drive shaft 101, and is moved back and forth along the threaded part 102 of the drive shaft 101 by manipulation of an operation lever 107. Between the pressure bearing member 103 and pressing drive member 108, a spring 109 is placed, and the spring 109 is thrust in a direction of detaching the pressure bearing member 103 and pressing drive member 108 from each other.

In the part of the drive shaft 101 projecting to the outer side in the axial direction (the right side in the drawing) from the pressing drive member 108, a rotation limiting member 110 is spline-coupled, while the operation wheel 111 is rotatably engaged with the outer circumference of the rotation limiting member 110. At the inner end of the rotation limiting member 110, a rotation limiting projection 113 is formed, and a pressing release projection 112 is formed at the inner end of the operation wheel 111. At the outer end of the pressing drive member 108, projections extending in the radial direction are formed. As the rotation limiting projection 113 protrudes among the projections of the pressing drive member 108, the angle of the pressing drive member 108 rotating about the drive shaft 101 is limited. When the operation wheel 111 is rotated counterclockwise as seen from the right side in the drawing, the pressing release projection 112 abuts against the protrusions of the pressing drive member, and the pressing drive member 108 is also rotated counterclockwise.

In the lever type hoist, incidentally, when a load is suspended on a lower hook attached to a load chain, it is rotated in the direction of the load sheave being pulled down by this load (in the counterclockwise direction). The load sheave works to rotate the drive shaft 101 in the same direction through a gear train. At this time, the pressing drive member 108 is stopped by the operation lever 107, and is prevented from rotating together with the drive shaft 101. Therefore, when the drive shaft 101 is put in rotation, the pressing drive member 108 screwed in the drive shaft 101 is moved toward the friction members 106 by resisting the pressing force of the spring 109, and presses the friction members 106, and rotation of the drive shaft 101 is arrested by the frictional force at this time.

When the load on the lower hook is large, by rotating the pressing drive member 108 in the clockwise direction, the reverse rotation preventive wheel 105 is forcefully pushed in between the pressing drive member 108 and pressure bearing member 103, and therefore the pressing state by the pressing drive member 108 will not be loosened during reciprocal rotation of the operation lever 107. In the lever type hoist shown in FIG. 27, however, since the spring 109 is placed between the pressure bearing member 103 and pressing drive member 108, and when the load suspended on the lower hook is small, the force of the spring 109 acting to detach the pressing drive member 108 from the friction members 106 may be greater than the force of moving the pressing drive member 108 toward the friction members 106. In such a case, if the pressing member 108 rotates in the clockwise direction, the reverse rotation preventive wheel 105 may not be held with a sufficiently strong force. When the operation lever is moved reciprocally in such a state, is the operation lever is turned in the counterclockwise direction, the small load suspended on the lower hook is moved downward by its own gravity, which induces a risk of not only damaging a colliding object during move, but also injuring the worker.

The invention is devised in the light of such problems, and it is hence a primary object of the invention to present a lever type hoist capable of preventing rotation of the drive shaft even when the load applied on the load sheave is smaller than a specific weight by keeping the pressing drive member in tight contact with the friction members, so that the small load may not move downward by its own weight. It is another object thereof to present a lever type hoist capable of rotating continuously and lightly when adjusting the position of the lower hook in no-load state.

SUMMARY OF THE INVENTION

To achieve the objects, the invention presents a lever type hoist comprising:

a drive shaft inserted in a load sheave and coupled with the load sheave through a gear train, a pressure bearing member disposed adjacently to the load sheave at the outer side in the axial direction, and fixed on the drive shaft, a pressing drive member screwed into the drive shaft, oppositely to the end surface of the pressure bearing member at the outer side in the axial direction, and to be engaged with an operation lever as required, a reverse rotation preventive wheel interposed between the pressure bearing member and pressing drive member, and disposed rotatably only in one direction on the drive shaft, a pair of friction members disposed on both surfaces of the reverse rotation preventive wheel, and disposed so as to be pressed by the pressing drive member, a rotation limiting member disposed adjacently to the outer side in the axial direction of the pressing drive member, and spline-coupled to the drive shaft, an operation wheel abutted to the rotation limiting member from the outer side in the axial direction, and disposed rotatably on the drive shaft, means for thrusting the operation wheel in a direction of pushing against the rotation limiting member, engaging means for engaging with part of the pressing drive member, being disposed on the operation wheel at a position confronting the pressing drive member, and engaged means disposed on the pressing drive member at a position confronting the operation wheel, and being formed so as to be engaged with the engaging-means.

When suspending a load on a load chain by engaging the operation lever with the pressing drive member, the pressing drive member tends to move to the inner side depending on the rotation of the drive shaft. At this time, between the pressure bearing member and the pressing drive member, unlike in the conventional apparatus, there is no spring that blocks the movement of the pressing drive member to the inner side. Accordingly, if the load is small, the pressing drive member is moved to the inner side to contact tightly with the friction members sufficiently, so that a frictional force is built up between the two. Hence, if the load is small, the load itself does not move downward by its own gravity.

Or, with the operation lever disengaged from the pressing driving member, by turning the operation lever in the counterclockwise direction, the engaging means of the operation wheel collides against the engaged means of the pressing drive member. By this collision, the pressing driving member is moved to the outer side (in the direction departing from the friction member). On the other hand, since the operation wheel is pressed to the rotation limiting member by the thrusting means disposed against the spring retainer, a frictional force is created on the contact surfaces of the operation wheel and rotation limiting member. Therefore, when the driving shaft rotates in such state, the rotation is transmitted to the pressing driving member through the rotation limiting member and operation wheel, so that the pressing drive member is caused to rotate together with the drive shaft. Consequently, the pressing drive member does not move to the inner side, and keeps a gap between the friction members, thereby allowing the load sheave to idle freely in the counterclockwise direction.

DETAILED DESCRIPTION OF THE PREFERRED EMBODIMENTS

Figure 1:
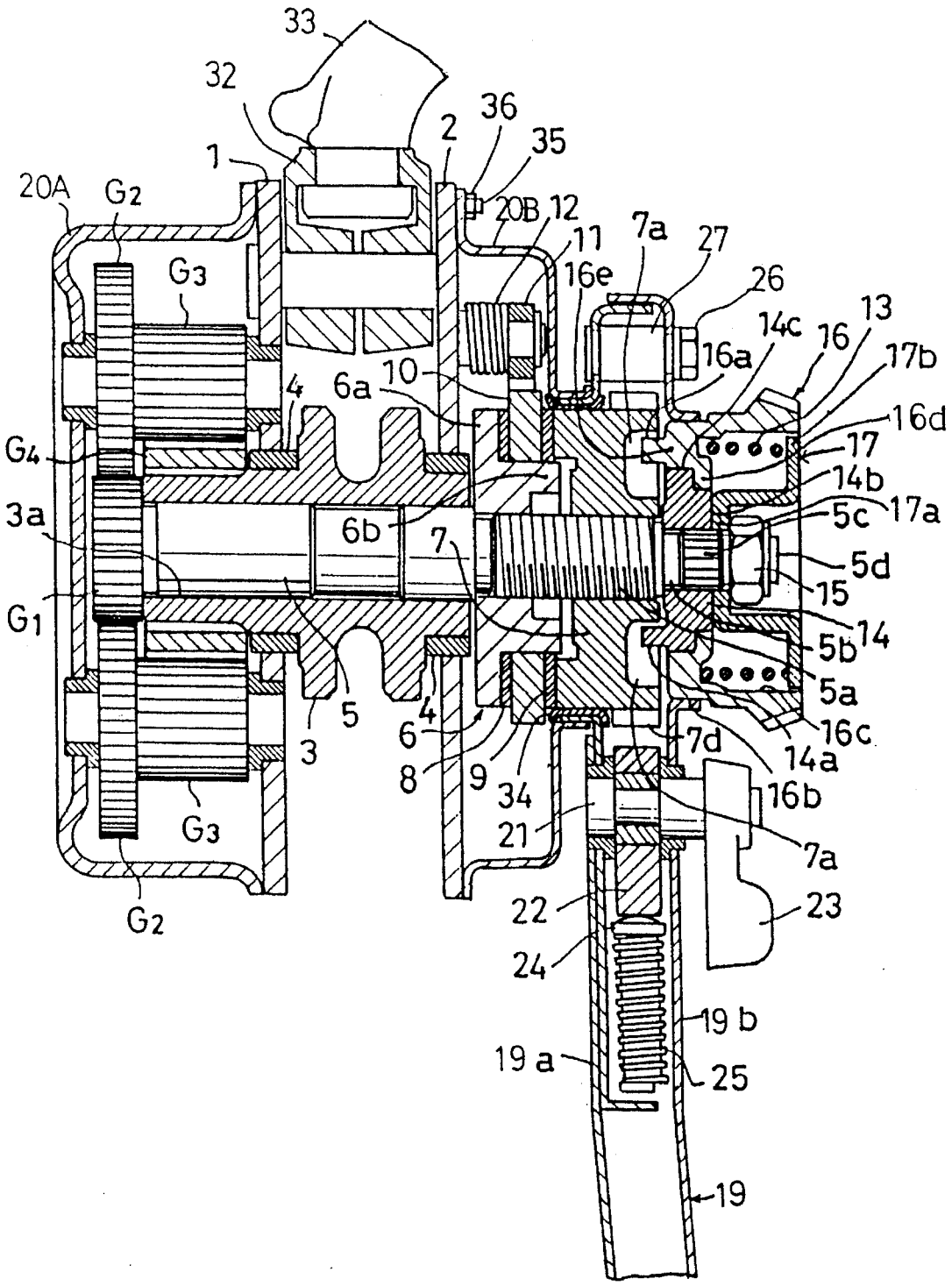
FIG. 1 is a longitudinal sectional view showing an embodiment of the invention.

Referring now to the drawings, some of the preferred embodiments of the invention are described in detail below.

FIG. 1 is a sectional view showing an embodiment of the invention, and this sectional view shows the lever type hoist from its side. As shown in FIG. 1, between a pair of side plates 1, 2 held parallel at a specific interval, a load sheave 8 is provided. The load sheave 3 is rotatably supported by bearings 4, 4. In the center of the load sheave 8, a shaft hole 8*a* is provided, and a drive shaft 5 is rotatably inserted in the shaft hole 8*a*. Both ends of the drive shaft 5 project from the right and left ends of the load sheave 3. At one projecting part of the drive shaft 5 (right side in FIG. 1), means for driving the load sheave 8 is disposed. At the right side projecting part of the drive shaft 5, a first threaded part 5*a*, a shaft part 5*b*, a spline part 5*c*, and a second threaded part 5*d* are formed sequentially from the side plate 2 side. Both the threaded parts 5*a*, 5*b* are right-hand threaded. At the other projecting part of the drive shaft 5 (left side in FIG. 1), a pinion G1 is provided. The pinion G1 is coupled with the load sheave 3 through a speed reducing gear train G2, G3, G4. These gears G1 through G4 are enveloped with a cover 20A provided in the side plate 1.

In the threaded part 5*a* of the drive shaft 5, a pressure bearing member 6 and a pressing drive member 7 are screwed from the side plate 2 side. The pressure bearing member 6 is screwed and fixed in the innermost part of the first threaded part 5*a*, and the pressing drive member 7 is screwed so as to be movable forward and backward in the axial direction. The pressure bearing member 6 has a disk part 6*a* and a boss part 6*b*, and the disk part 6*a* is close to the side plate 2, while the boss part 6*b* is formed so as to project outward in the axial direction from the middle of the disk 6*a*. In the boss part 6*b*, a pair of friction members 8, 9 and a reverse rotation preventive wheel 10 interposed between them are fitted.

The reverse rotation preventive wheel 10 has detent teeth inclining in one way of the circumferential direction disposed on its outer circumference. The reverse rotation preventive wheel 10 and the friction members 8, 9 disposed at both its sides are designed to be pressed by the pressing drive member 7, and are composed so as to be held between the disk part 6*a* and pressing drive member 7. The numeral 11 is a ratchet pivoted by the side plate 2. This ratchet 11 is pressed to the outer circumference of the reverse rotation preventive wheel 10 by a spring 12. The ratchet 11 is engaged with the detent teeth of the reverse rotation preventive wheel 10, and guides the reverse rotation preventive wheel 10 so as to be rotatable only in the hoisting direction of the load sheave 3.

Adjacently to the pressing drive member 7, a rotation limiting member 14 is provided. The rotation limiting member 14 is spline-coupled to the spline part 5*c* of the drive shaft 5, and is fixed with a nut 15. The nut 15 is screwed into the second threaded part 5*d*. In the rotation limiting member 14, a rotation limiting projection 14*a* is formed in the end surface confronting the pressing drive member 7, and a boss 14*b* is formed outward in the axial direction at the opposite end surface. The rotation limiting projection 14*a* protrudes into an annular hole 7*a* formed in the pressing drive member 7. The rotation limiting projection 14*a* abuts against the projections of the pressing drive member 7 to prevent the pressing drive member 7 from rotating more than necessary on the drive shaft 5, thereby preventing the pressing drive member 7 from moving to the outer side in the axial direction unnecessarily.

On the outer circumference of the boss part 14*b* of the rotation limiting member 14, an operation wheel 16 is rotatably fitted to the rotation limiting member 14. The operation wheel 16 is formed so as to contact with the outer circumferential surface of the rotation limiting member 14. A recess 16*c* is formed in the operation wheel 16 at the outer side in the axial direction. In this recess 16*c*, a spring retainer 17 is fixed to the drive shaft 5 by the nut 15. The spring retainer 17 is formed in one body together with the rotation limiting member 14 or drive shaft 5, or formed as an independent element. In FIG. 1, the spring retainer 17 is formed as an independent element. The spring retainer 17 pushes out the middle part of a drilled disk, and forms a central bump 17*a*, and also forms a flange 17*b* in the peripheral edge. The bottom of the central bump 17*a* is pressed and fixed to the outer end surface in the axial direction of the rotation limiting member 14 by the nut 15.

The outer diameter of the central bump 17*a* of the spring retainer 17 may be set slightly larger than the outer diameter of the boss part 14*b* of the rotation limiting member 14 which contacts with it. In this case, the guide part 16*d* of the inner periphery of the bottom wall of the recess 16*c* of the operation wheel 16 is set slightly lower than the end surface of the boss part 14*b* of the rotation limiting member so as not to contact with the bottom of the central bump 17*a* of the spring retainer 17. In this setting, unnecessary contact of the operation wheel 16 does not occur, and moreover when the operation wheel 16 is pulled to the outer side, the operation wheel 16 is not dislocated from the rotation limiting member 14. Accordingly, the engagement of the pressing release projection 16*a* with the two projections 7*b*, 7*c* will never be cleared.

Between the flange 17*b* of the spring retainer 17 and the bottom wall 16*e* of the recess 16*c* of the operation wheel 16, a compression spring 13 is interposed as thrusting means for pressing the operation wheel 16 to the rotation limiting member 14.

In a recessed bottom wall 16*e* of the operation wheel 16 confronting the pressing drive member 7, the pressing release projection 16*a* protruding into the annular hole 7*a* of the pressing drive member 7 is provided. The pressing release protrusion 16*a* abuts against the protrusions of the pressing drive member 7, and rotates the pressing drive member 7 in the counterclockwise direction on the drive shaft 5, thereby moving the pressing drive member 7 to the outer side in the axial direction.

In the annular hole 7*a* of the pressing drive member 7, the first projection 7*b* and second projection 7*c* for dividing the protruding part of the rotation limiting projection 14*a* of the rotation limiting member 14 and the protruding part of the pressing release projection 16*a* of the operation wheel 16 are disposed, extending in the radial direction. The central angles 7*a*-1, 7*a*-2 of the two portions of the annular hole 7*a* divided by the first projection 7*b* and second projection 7*c* are largely different from each other as shown in FIG. 4.

Figure 4:
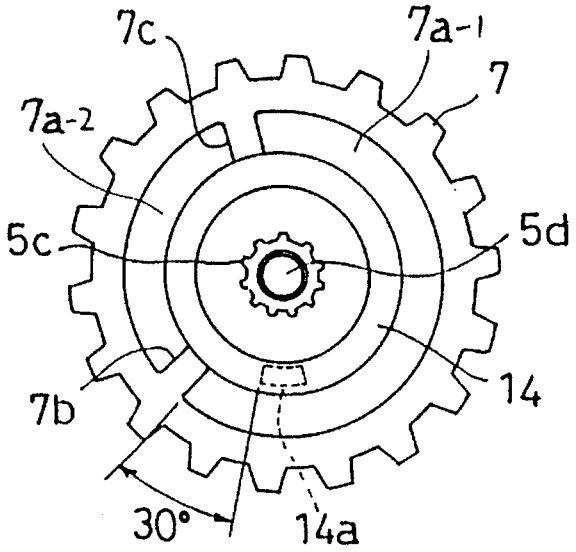
FIG. 4 is a front view showing the positioning relation of the pressing driving member and rotation limiting member.
Figure 5:
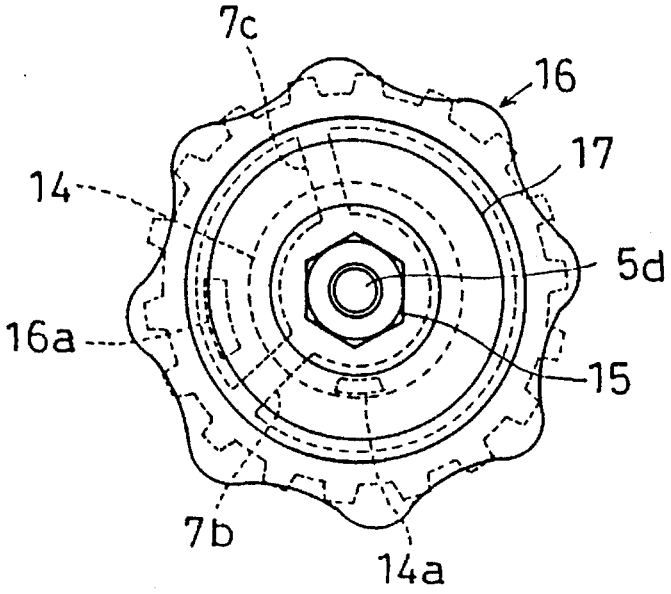
FIG. 5 is a front view showing the installed state of the operation wheel and spring retainer in the state as shown in FIG. 4.
Figure 6:
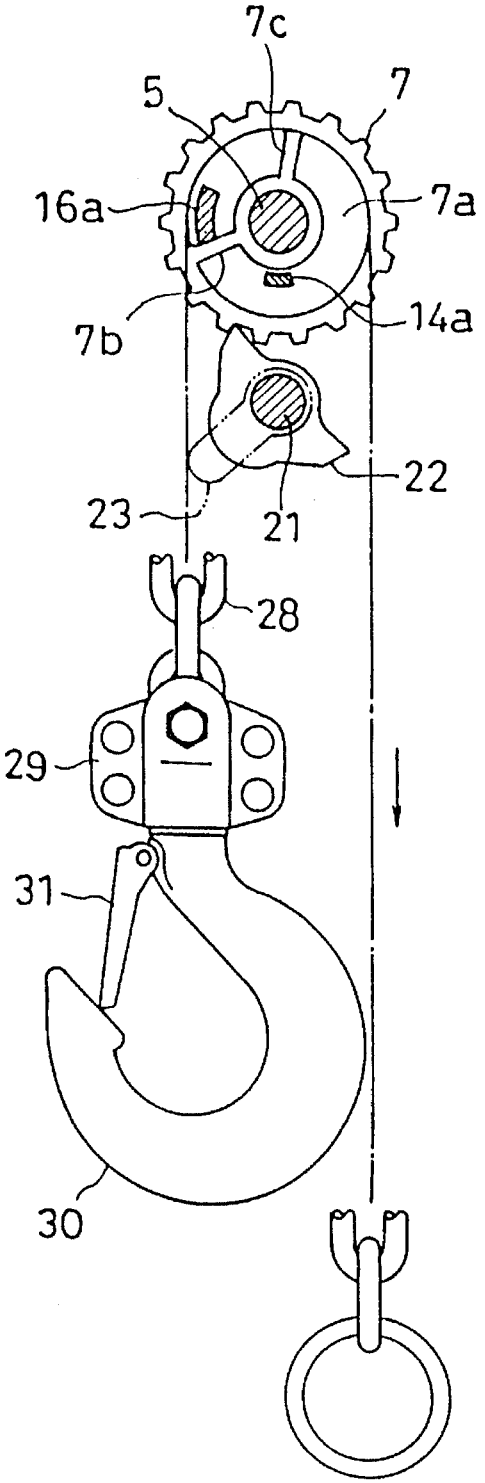
FIG. 6 is an essential front view showing the state of hoisting the load.
Figure 7:
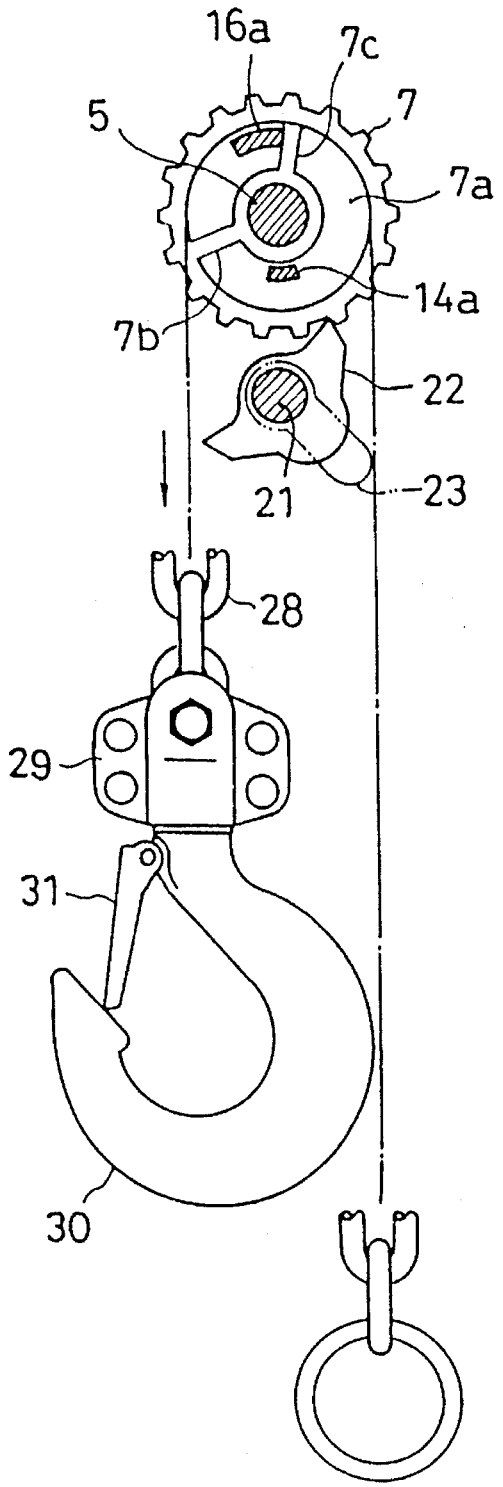
FIG. 7 is an essential front view showing the state of lowering the load.

FIG. 4 shows the pressing drive member 7 and rotation limiting member 14 as seen from the right direction in FIG. 1. The annular hole 7*a* of the pressing drive member 7 is divided by the first projection 7*b* and second projection 7*c*, and the annular hole 7*a*-1 of a larger opening angle and the annular hole 7*a*-2 of a smaller opening angle are formed. The rotation limiting projection 14*a* of the rotation limiting member 14 protrudes into the annular hole 7*a*-1, while the pressing release projection 16*a* protrudes into the annular hole 7*a*-2 (FIG. 5).

In the embodiment in FIG. 1, the engaging means formed on the operation wheel 16 is composed of the pressing release projection 16*a*, and the engaged means formed on the pressing drive member 7 is composed of the first projection 7*b* of the annular hole, but the engaging means and engaged means may be composed by forming a sector hole in the operation wheel 16 and forming a projection on the pressing drive member 7.

Positioning of the rotation limiting member 14 on the pressing drive member 7 is effected by fitting it to the spline part 5*c* of the drive shaft 5 (see FIG. 4) so that the rotation limiting projection 14a may have an angle of about 30 degrees to the rotation side of the lowering direction to the first projection 7*b* of the pressing driving member 7. The operation wheel 16 is fitted to the outer circumference of the rotation limiting member 14, assembled with the spring 13 and spring retainer 17, and fixed with the nut 15.

The gear 7*d* of the pressing drive member 7 is held in the operation lever 19. The operation lever 19 is composed of an inner lever case 19*a* and an outer lever case 19*b*. In the inner lever case 19*a*, an opening surrounding the friction member 9 side of the pressing drive member 7 is provided. In the outer lever case 19*b*, an opening surrounding the cylindrical outer circumference 16*b* of the operation wheel 16 is provided. The inner lever case 19*a* and outer lever case 19*b* are coupled into one body by means of a plurality of screws 26, 26, . . . , and nuts 27, 27, . . . .

The operation lever 19 is extended to the lower side of the pressing drive member 7, and a rotating direction changeover pawl 22 is provided in its inside. The rotating direction changeover pawl 22 is supported by a shaft 21 so as to be rotatable on both the lever cases 19*a*, 19*b*. The shaft 21 protrudes to the outside of the operation lever 19, and is provided with a handle 23 for changeover in the protruding part. By changing over and manipulating the handle 23, the rotating direction changeover pawl 22 is engaged so as to rotate the pressing drive member 7 in the hoisting direction or lowering direction, and is also held in the neutral position so as not to be rotated in either direction. On the lower end of the rotating direction changeover pawl 22, a pressing member 24 thrust upward by a spring 25 abuts to keep contact, and thereby the rotating direction changeover pawl 22 is resiliently held at the specified changeover position.

Figure 2:
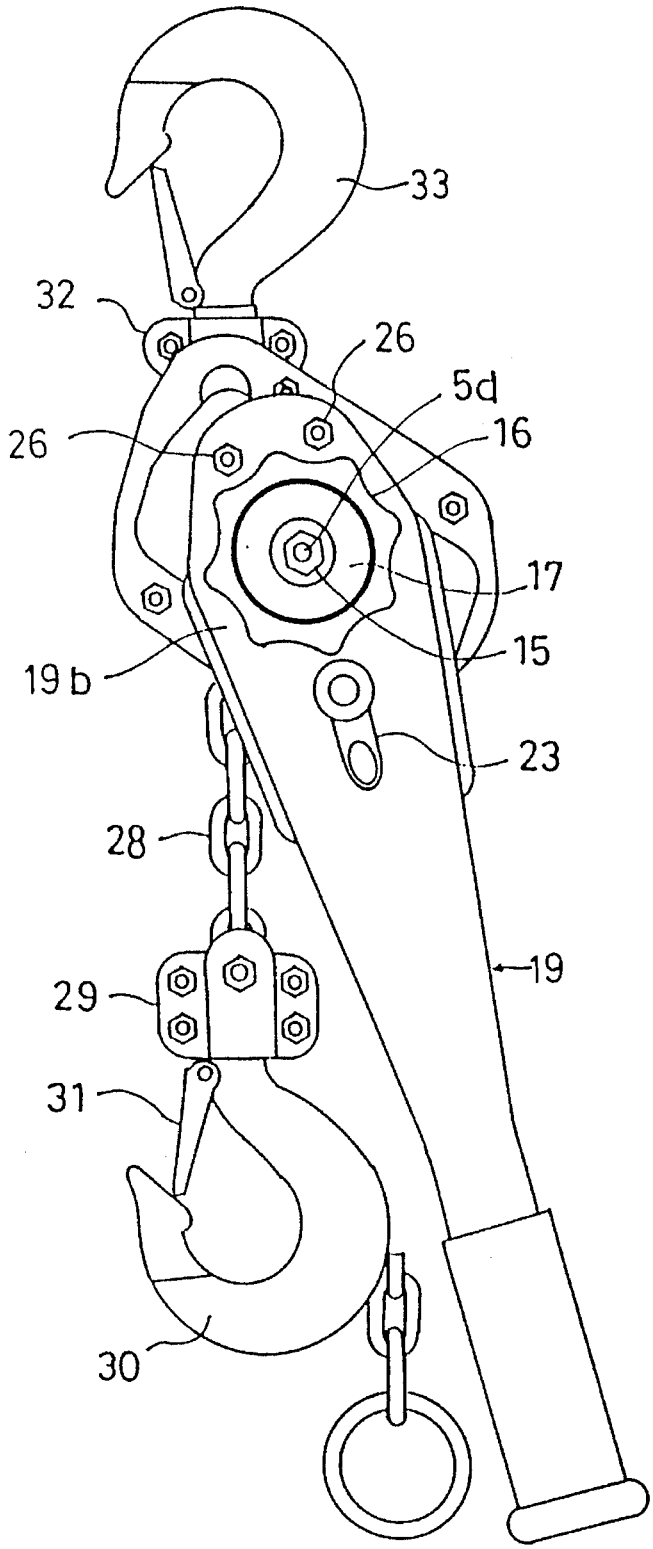
FIG. 2 is a right front view of FIG. 1.
Figure 3:
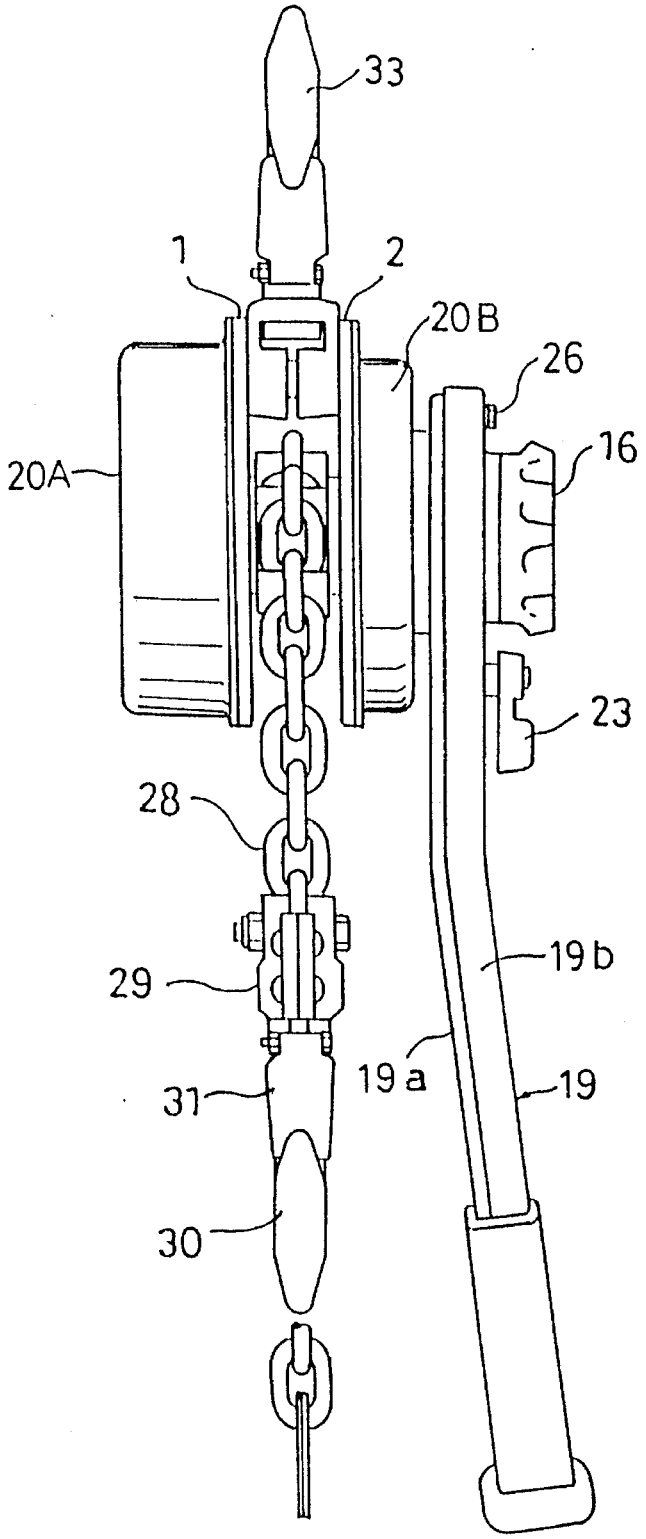
FIG. 3 is a left side view of FIG. 2.

As shown in FIGS. 2 and 3, in the upper part between both the sides plates 1, 2, an upper hook 33 is provided through a coupling piece 32. At the lower end of the load chain 28 wound around the load sheave 3, a lower hook 30 for lowering the load is coupled with a coupling piece 29. The numeral 31 is a load catch, which is pivoted on the upper part of the lower hook 30 so as to be rotatable only to the inner side.

The numeral 20B shown in FIG. 1 is a cover fitted to the side plate 2 with a plurality of screws 35 and nuts 36. The central tubular opening of the cover 20B is overlapped with the outer circumference of the tubular opening of the inner lever case 19*a* so that the operation lever 19 is free to rotate in both directions. In the tubular opening of the inner lever case 19*a*, a stopper tubular member 34 of pi-section for defining the move of the operation lever 19 in the axial direction is inserted. The stopper tubular member 34 is, for example, made of a steel plate.

In the thus constituted lever type hoist, its operation is described below.

a. Action when a small load is suspended

When hoisting a small load which is suspended on the lower hook 30, the pressing drive member 7 rotates clockwise, and the drive shaft 5 is put in clockwise rotation. At this time, the load of the load sheave is applied to the drive shaft 5 through the speed reducing gear train, and the winding-up force by the operation lever is applied to the pressing drive member 7, so that the frictional force built up between the rotation limiting member 14 and the operation wheel 16 is very small as compared with the rotational force applied from the operation lever. Furthermore, since there is no spring for blocking the pressing force between the pressure bearing member 6 and the pressing drive member 7, the pressing force of the pressing drive member 7 is directly changed into the holding force of the reverse rotation preventive wheel 10. As a result, the pressing drive member 7 contacts tightly with the friction member 9, so that a sufficient braking effect is exhibited, so that dropping of the small load can be sufficiently prevented. When the load is large, the contact is further strengthened, and more secure braking effect is exhibited.

b. Idling action in no-load state

Figure 8:
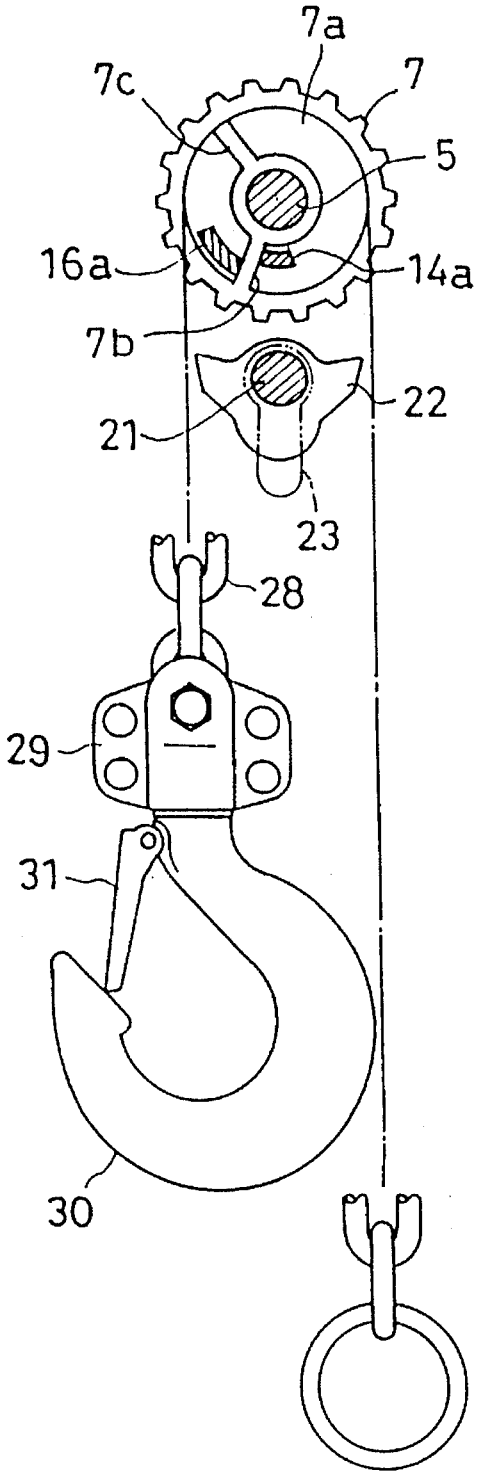
FIG. 8 is an essential front view when changed over to a no-load state.
Figure 9:
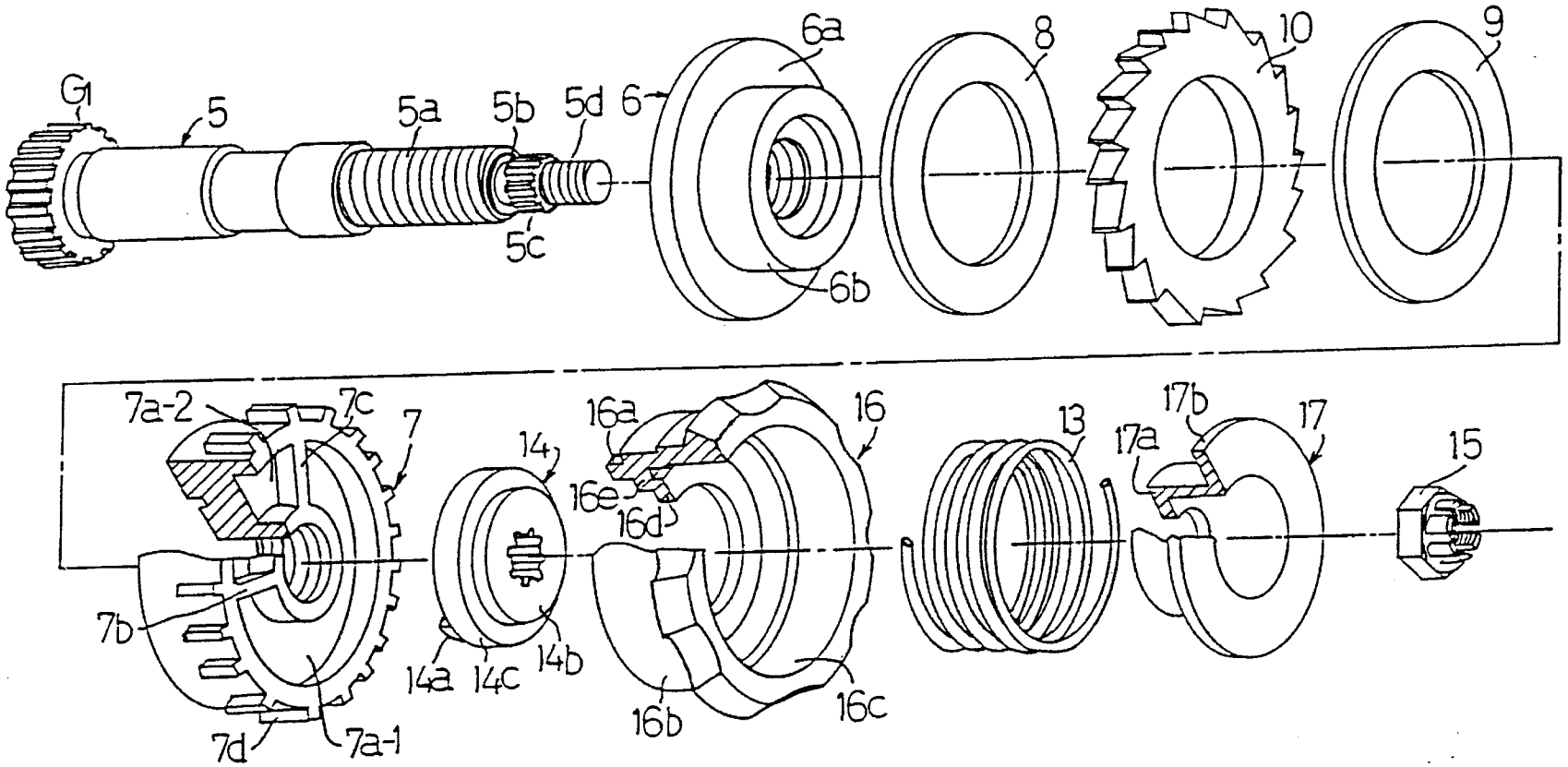
FIG. 9 is a developed diagram of essential parts in FIG. 1.

In idling action, in the first place, the handle 23 for changeover is moved to the neutral position. Next, the operation wheel 16 is turned counterclockwise. By this operation, the pressing release projection 16*a* of the operation wheel 16 moves in the annular hole 7*a*-2 of the smaller opening angle of the pressing drive member 7, and collides against the first projection 7*b* of the pressing drive member 7, and rotates the pressing drive member 7 in the counterclockwise direction (see FIG. 8).

Consequently, the pressing drive member 7 is moved to the outer side along the right-hand threads of the first threaded part 5*a* formed in the drive shaft 5, and a gap is formed between the pressing drive member 7 and friction member 9 so as to allow idling.

In idling state, when the load chain 28 of the lower hook 30 side in no-load state is pulled to the lower side, the drive shaft 5 rotates in the counterclockwise direction to move the pressing drive member 7 to the inner side. However, since the pressing drive member 7 is friction-coupled with the rotation limiting member 14 through the operation wheel 16, and the rotation limiting member 14 is further spline-coupled with the drive shaft 5, the pressing drive member 7 cannot rotate freely on the drive shaft 5 and follows its rotation. Hence, the pressing drive member 7 is prevented from moving to the inner side, and thus the pressing drive member 7 does not contact with the friction member 9, thereby keeping the idling state.

Figure 10:
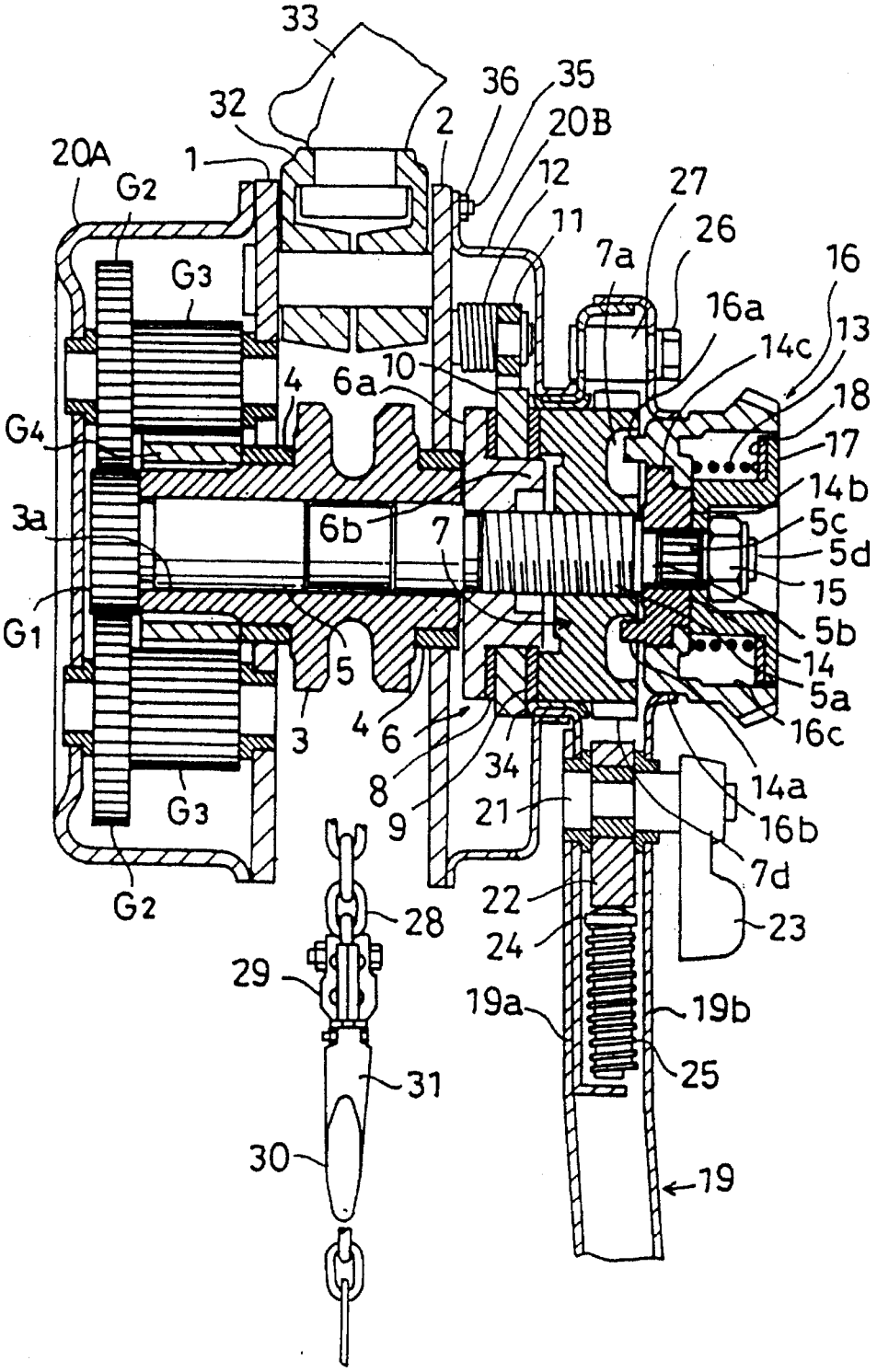
FIG. 10 is a longitudinal sectional view showing another embodiment of the invention.
Figure 11:
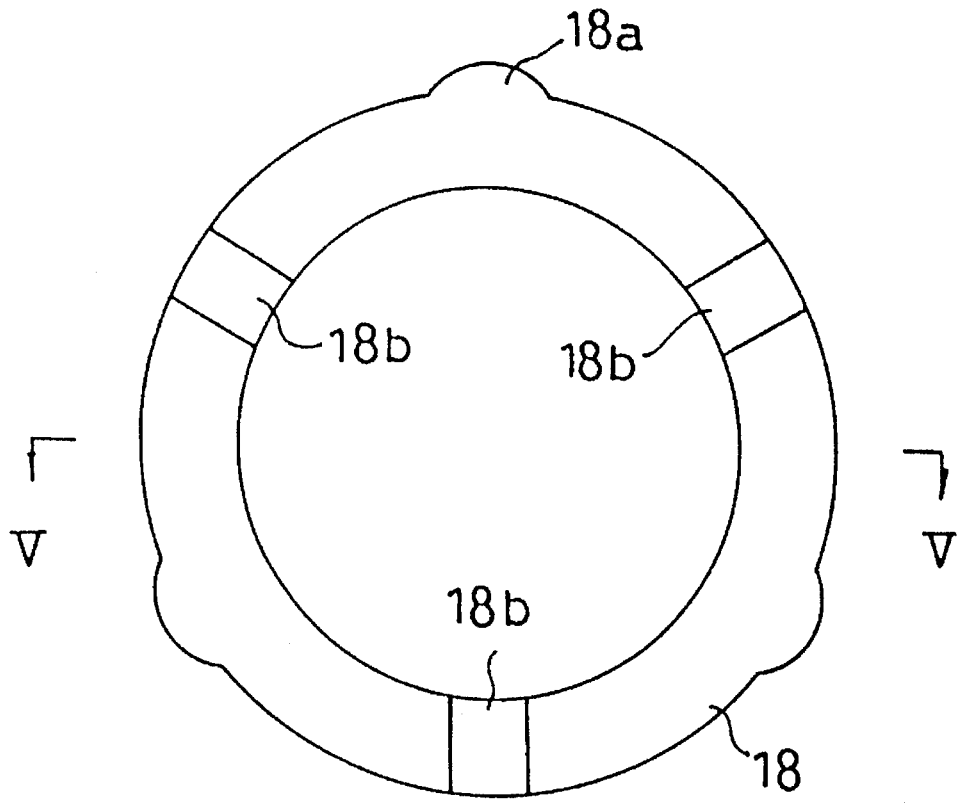
FIG. 11 is a plan view of an idle holding plate.
Figure 12:
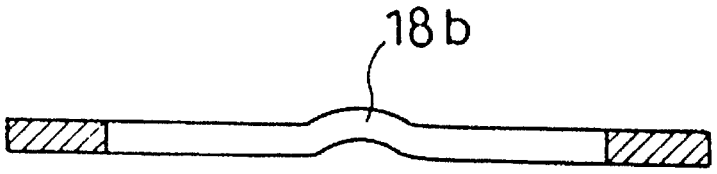
FIG. 12 is a sectional view of V—V in FIG. 11.
Figure 18:
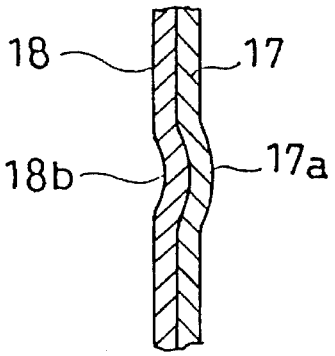
FIG. 18 is a sectional view of X—X in FIG. 17.

FIG. 10 shows a second embodiment in which an annular idling holding plate 18 is inserted in the inner side of the spring retainer 17. This idling holding plate 18 has three arc-shaped bumps 18*a* formed on the outer circumference as shown in FIG. 11, and concave and convex parts 18*b* projecting in arc form toward the outer side are formed on the middle annular surface of these bumps 18*a*. In the spring retainer 17 spline-coupled with the drive shaft 5, three concave and convex parts 17*a* to be engaged with the concave and convex parts 18*b* of the idling holding plate 18 are formed (FIG. 18).

Figure 15:
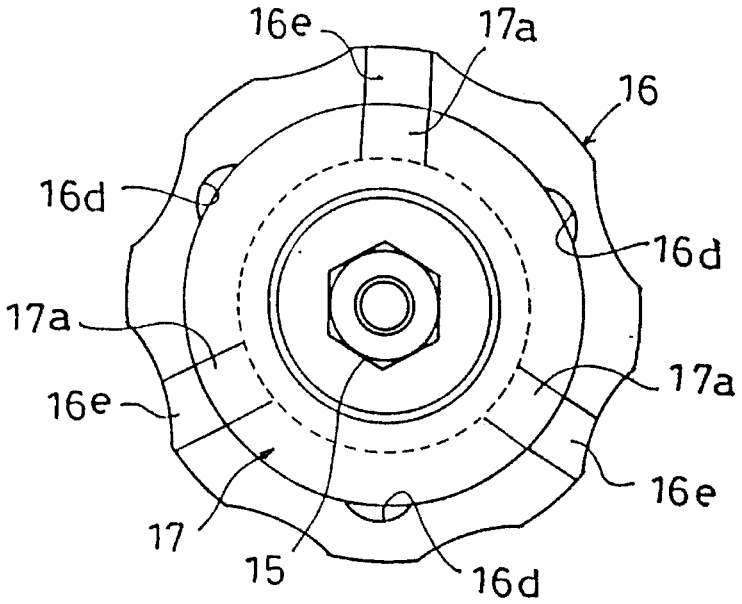
FIG. 15 is a front view of the operation wheel in the engaged state of the spring retainer and idle holding plate.
Figure 16:
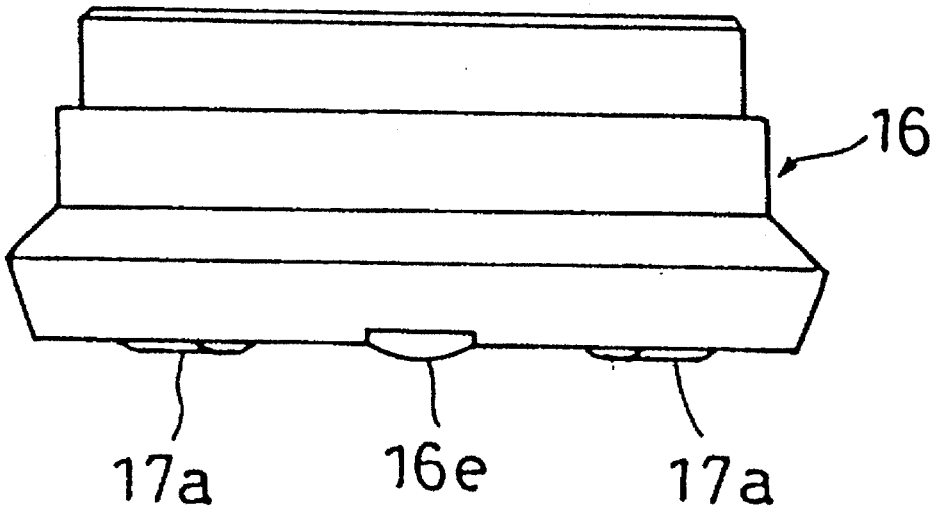
FIG. 16 is a top view of FIG. 15.
Figure 20:
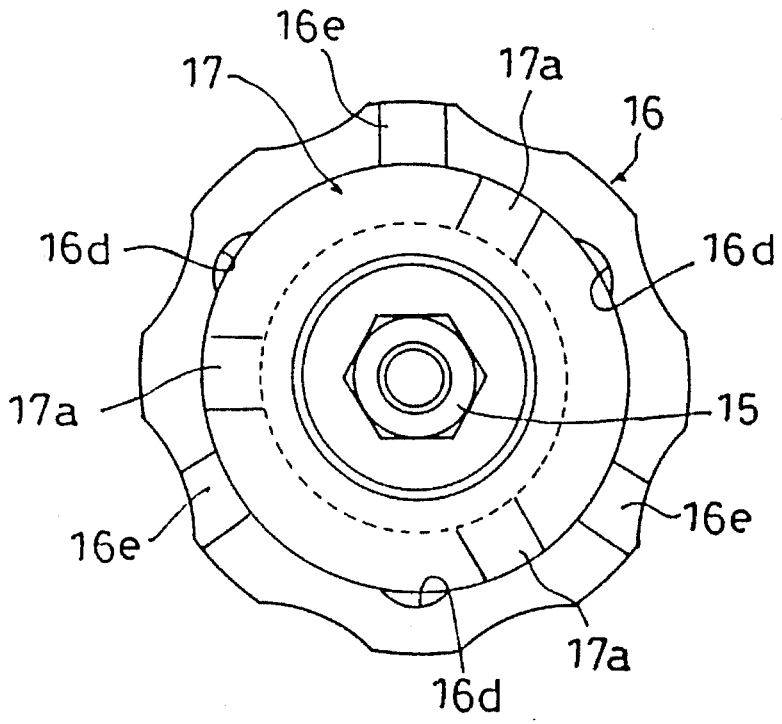
FIG. 20 is a front view of the operation wheel release of the engaged state of the spring retainer and idle holding plate.
Figure 21:
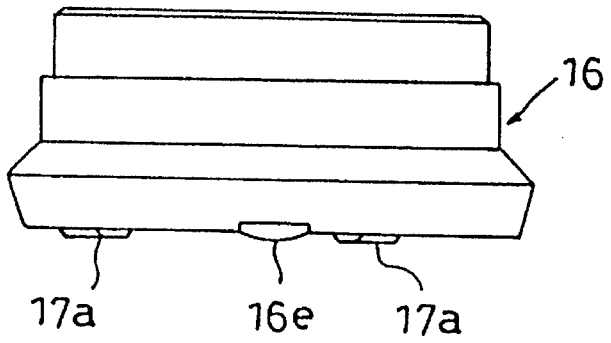
FIG. 21 is a top view of FIG. 20.
Figure 22:
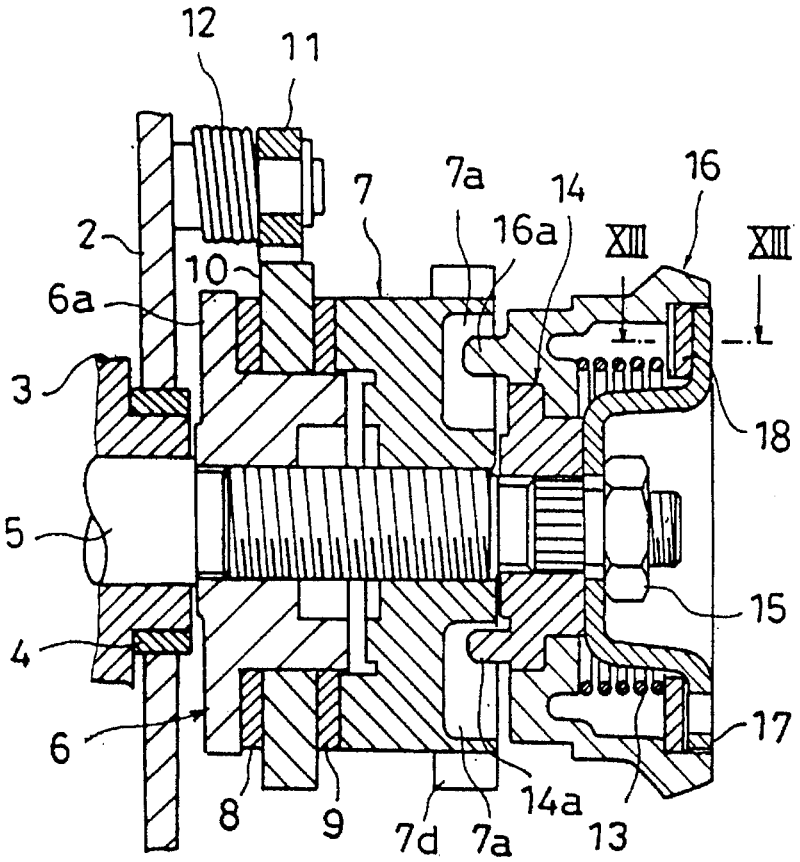
FIG. 22 is a longitudinal sectional view showing essential parts in FIG. 10 in load lowering.

Three engaging recesses 16*d* are formed inside the hole 16*c* of the operation wheel 16 (FIG. 15). The bumps 18*a* of the idling holding plate 18 are guided into the engaging recess 16*d* of the operation wheel 16, and hence the idling holding plate 18 rotates together with the operation wheel (FIGS. 15, 20). A spring 13 is inserted between the bottom of the hole 16*c* and the idling holding plate 18, and the spring 13 presses the idling holding plate 18 and operation wheel 16 to the spring retainer 17 and rotation limiting member 14, respectively.

On the end surface of the operation wheel 16, three display parts 16*e* for displaying the engaged state of the concave and convex parts 18*b* of the idling holding plate 18 and the concave and convex parts 17*a* of the spring retainer 17 are formed. Consequently, as shown in FIG. 15, when the display parts 16*e* coincide with the concave and convex parts 17*a* of the spring retainer 17, it means that the concave and convex parts 18*b* of the idling holding plate 18 are engaged with the concave and convex parts 17*a* of the spring retainer 17 (FIG. 18). On the other hand, as shown in FIG. 20, when the display parts 16*e* are not matched with the concave and convex parts 17*a* of the spring retainer 17, it means the engagement of the two is cleared.

The operation of the thus constituted lever type hoist is explained below in the idling state and idling canceled state.

a. Idling state

Figure 13:
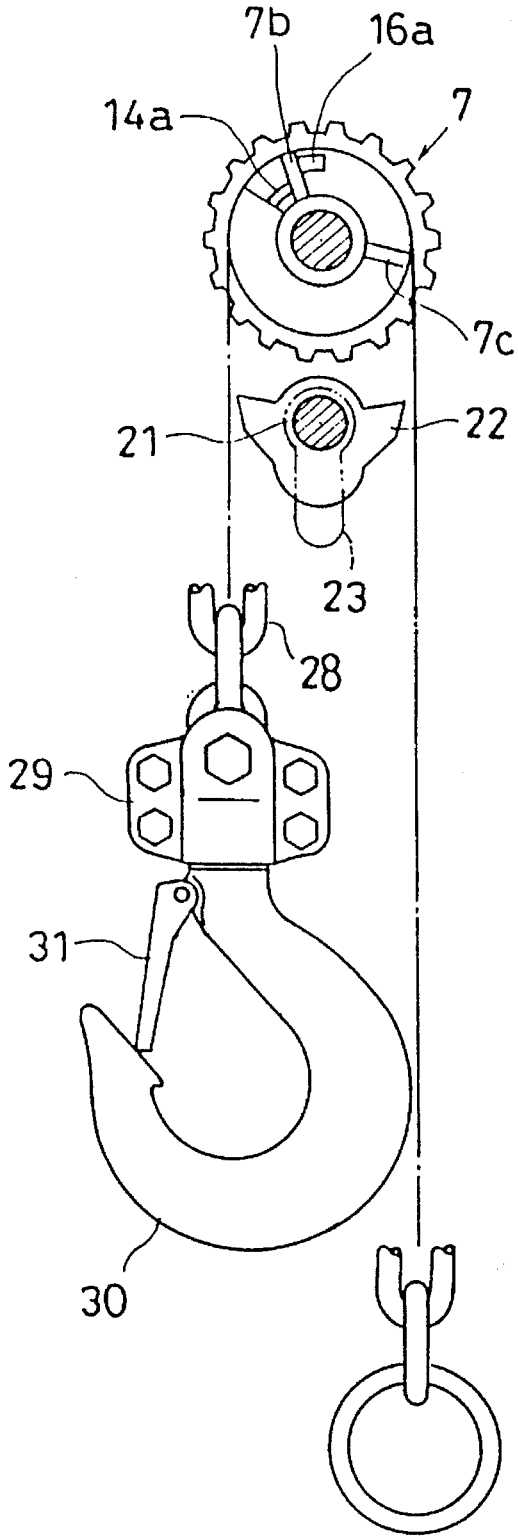
FIG. 13 is a front view showing the relation between the pressing drive member and rotation changeover pawl at the time of adjustment of chain length.
Figure 14:
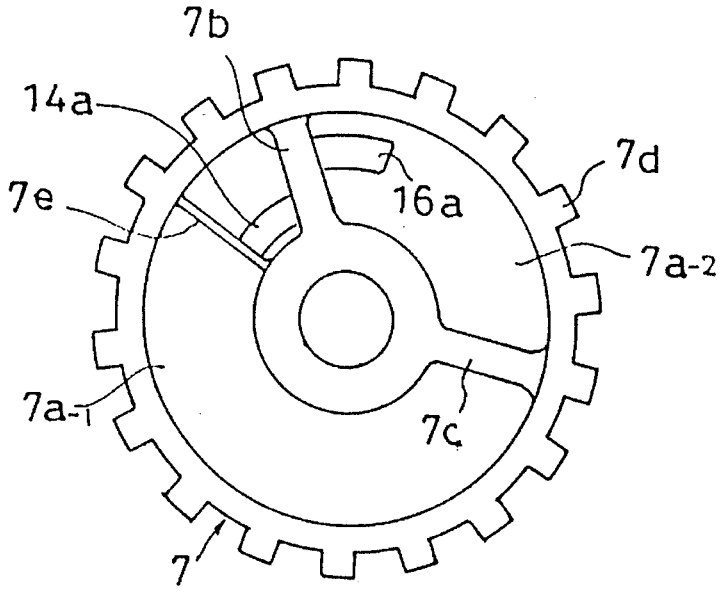
FIG. 14 is a front view showing the engagement relations between projections of the pressing drive member in the radial direction, the rotation limiting projection of the rotation limiting member, and the pressing release projection of the operation wheel.

To adjust the length of the load chain, the lever type hoist must be set in idling state. In this case, after changing over the rotating direction changeover pawl 22 in the neutral position, the end side chain 28 is fixed by hand, and the operation wheel 16 is rotated counter-clockwise until the concave and convex parts 18*b* of the idling holding plate 18 are engaged with the concave and convex parts 17*a* of the spring retainer 17 (FIG. 15). FIGS. 13 and 14 show the engaged state of the first projection 7*b* of the pressing drive member 7, the rotation limiting projection 14*a* of the rotation limiting member 14, and the pressing release projection 16*a* of the operation wheel 16 in this state. Incidentally, the numeral 7*e* denotes a marker line formed in the annular hole 7*a* of the pressing drive member 7, and it is formed in the position coinciding with one end of the rotation limiting projection 14*a* in the state shown in FIG. 14.

Figure 17:
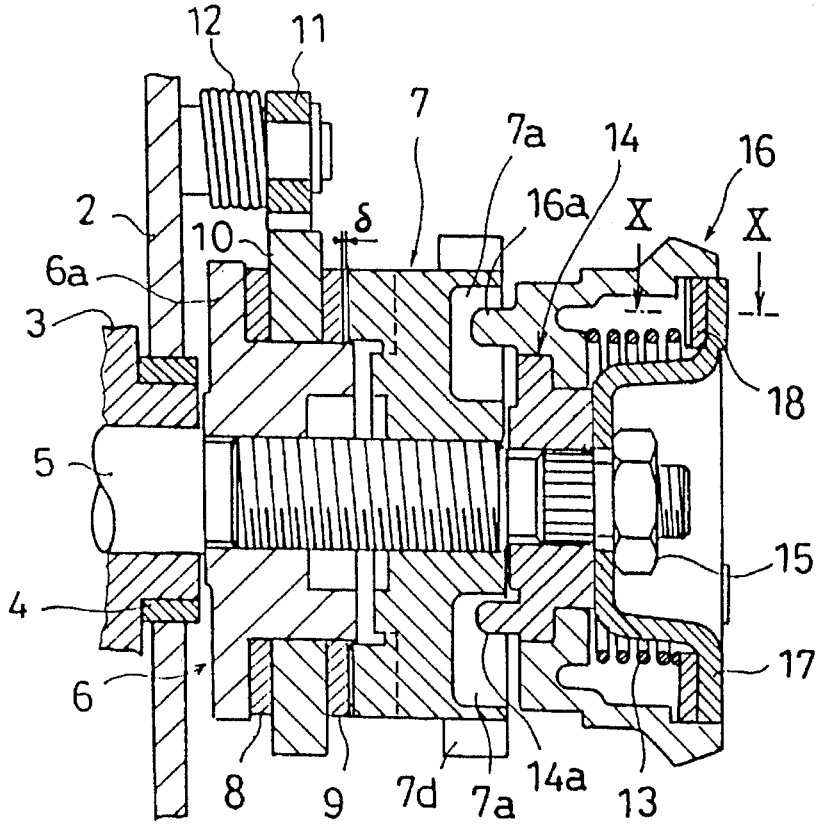
FIG. 17 is a longitudinal sectional view showing essential parts in FIG. 10 in adjustment of chain length.

In this state, by the pressing force of the spring 13, the concave and convex parts 18*b* of the idling holding plate 18 are securely engaged with the concave and convex parts 17*a* of the spring retainer 17 (FIG. 18). The pressing drive member 7 is securely held at a gap of 8 against the friction member 9 (see FIG. 17). This state is maintained even when releasing a hand from the operation wheel 16, so that the load sheave 3 and drive shaft 5 turn into idling state.

Accordingly, the length of the load chain 28 may be adjusted smoothly and efficiently even from the floor considerably remote from the lever type hoist. That is, if the load chain is stretched over the entire length, the drive shaft 5, rotation limiting member 14, spring retainer 17, idling holding plate 18, operation wheel 16, and pressing drive member 7 always rotate in unison, so that the pressing drive member 7 and the friction member 9 do not contact with each other.

b. Idling canceled state

Figure 19:
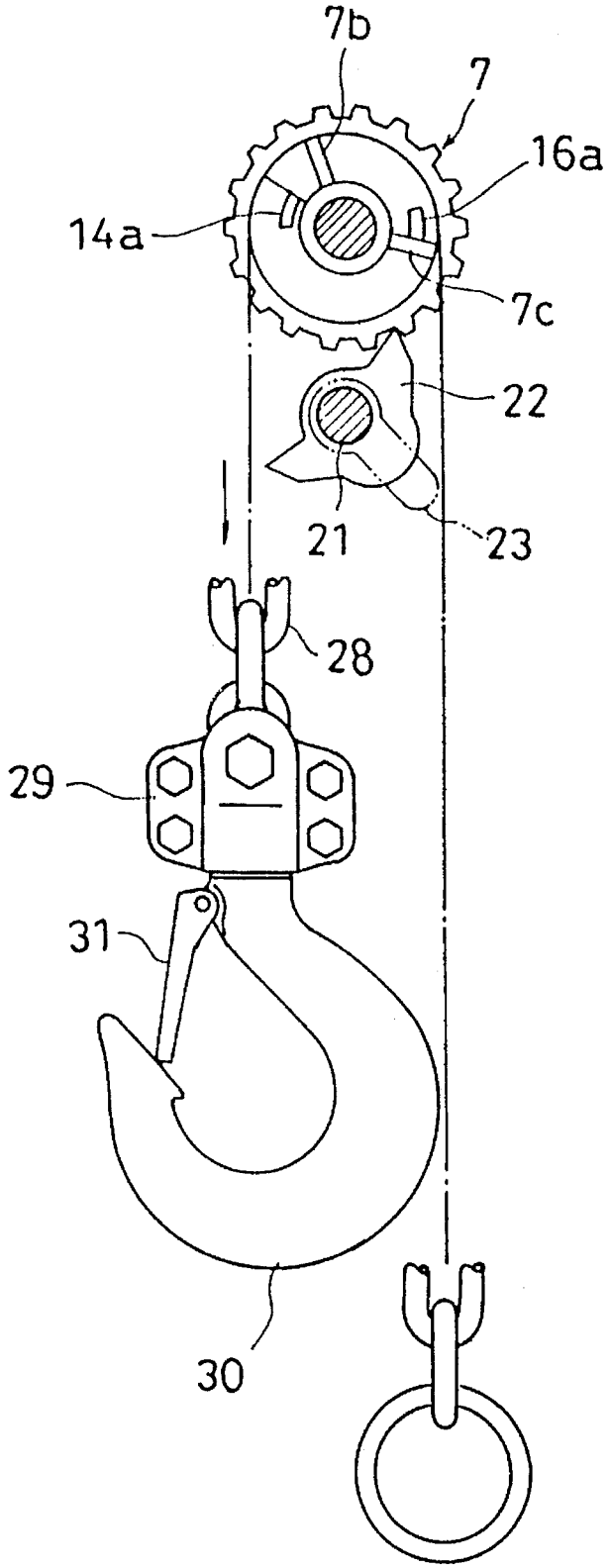
FIG. 19 is a front view showing the relation between the pressing drive member and rotating direction changeover pawl in load lowering.
Figure 23:
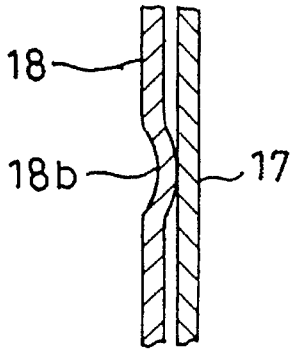
FIG. 23 is a sectional view of XIII—XIII in FIG. 22.

To cancel the idling state, the operation wheel 16 must be rotated in the clockwise direction. When the operation wheel 16 is rotated in the clockwise direction, the pressing release projection 16*a* of the operation wheel 16 moves in the annular hole 7*a*-2 with the smaller opening angle of the pressing drive member 7, and collides against the second projection 7*c* of the pressing drive member 7, thereby rotating the pressing drive member 7 in the clockwise direction (see FIG. 19). At this time, the concave and convex parts 18*b* of the idling holding plate 18 are disengaged from the concave and convex parts 17*a* of the spring retainer 17 (see FIG. 23), and the display parts 16*e* of the operation wheel 16 are cleared from the concave and convex parts 17*a* of the spring retainer 17 (FIG. 20). The pressing drive member 7 is rotated clockwise on the drive shaft 5, so that the pressing drive member 7 contacts tightly with the friction member 9.

c. Load suspended state

When a load is suspended on the lower hook 30, the load sheave 3 and drive shaft 5 rotate in the counterclockwise direction. Accordingly, the pressing drive member 7 screwed into the drive shaft 5 is rotated clockwise on the drive shaft 5, so that the pressing drive member 7 and friction member 9 contact with each other. At this time, since there is no spring that impedes pressing between the pressure bearing member 6 and the pressing drive member 7, the pressing force by the pressing drive member 7 is directly changed into the holding force of the reverse rotation preventive wheel 10. As a result, the pressing drive member 7 contacts with the friction member 9 to exhibit a sufficient braking effect, so that dropping of the load can be prevented securely.

Figure 24:
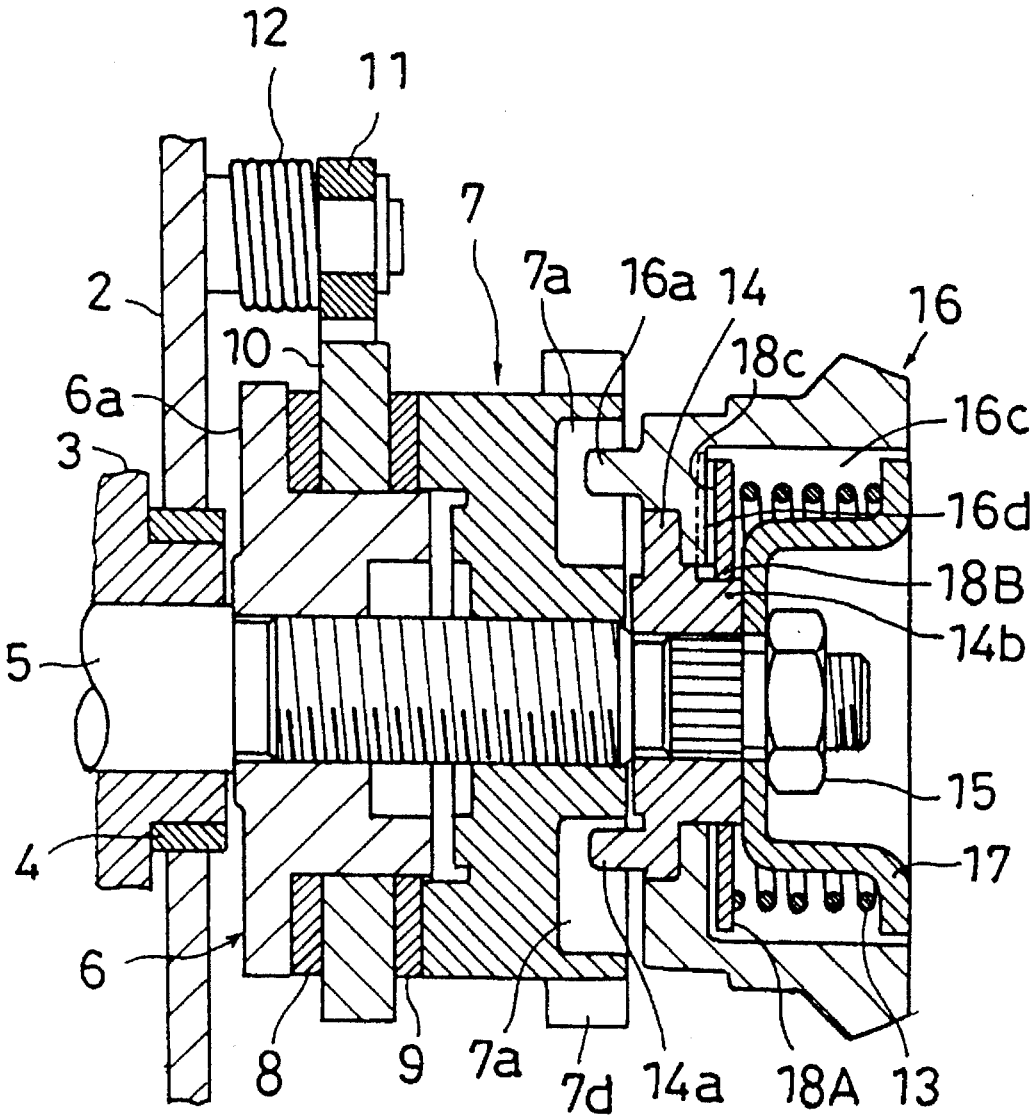
FIG. 24 is a longitudinal sectional view showing another embodiment modifying a part of FIG. 10.
Figure 25:
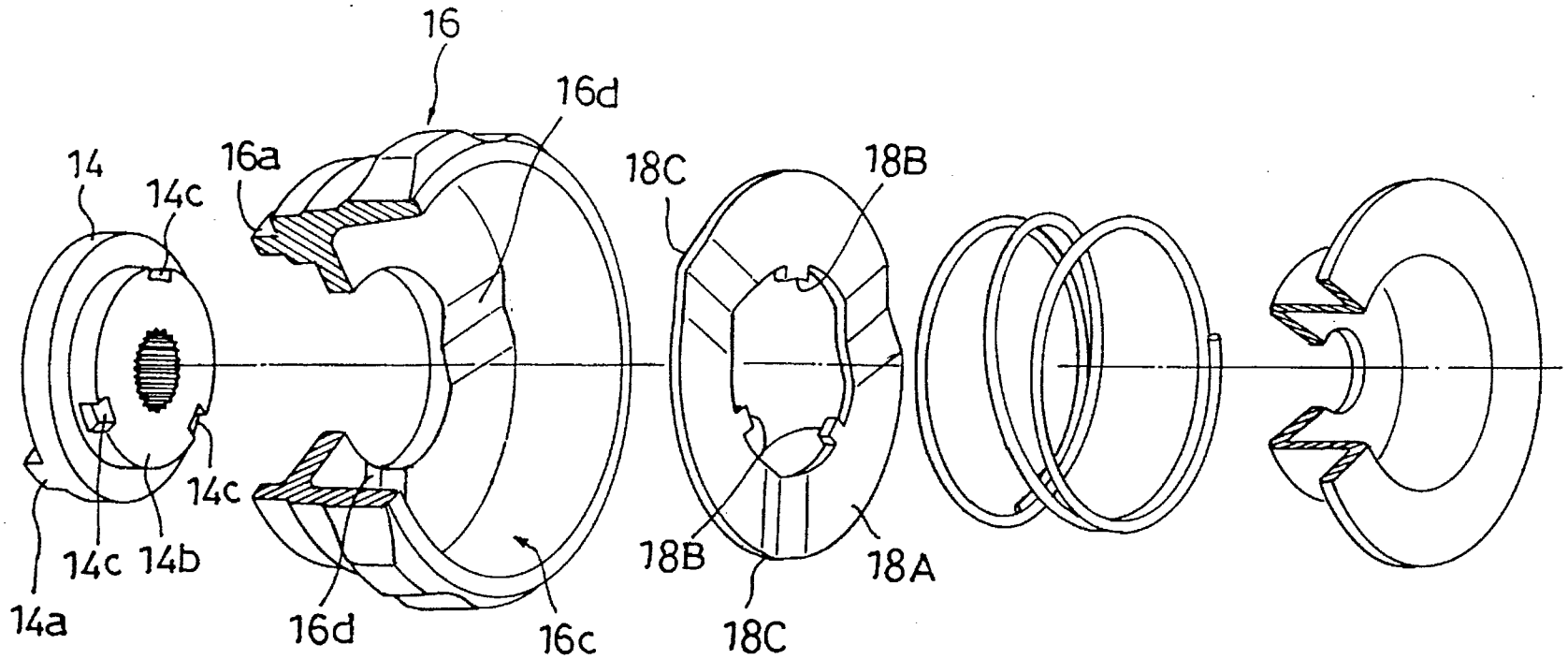
FIG. 25 is a developed diagram of essential parts in FIG. 24.

FIGS. 24 and 25 show a different embodiment of the apparatus shown in FIG. 10, in which an annular idling holding plate 18A is fitted into a boss 14*b* of the rotation limiting member 14, and is guided into a groove 14*c* of the boss 14*b* of the rotation limiting member 14 by a plurality of bumps 18B formed on the inner circumference, and at the same time engaged with a bottom recess 16*d* of a hole 16*c* of the operation wheel 16 by a plurality of bumps 18C formed in the radial direction of the annular surface. In this constitution, too, the same action and effect as mentioned in the foregoing embodiments are obtained. The pressing drive member 7 in the embodiments may be divided into two, for example, as indicated by a broken line in FIG. 17, and the divided portion at the friction member 9 side may be fitted into the boss of the pressing drive member 7 having a gear 7*d*.

Figure 26A:
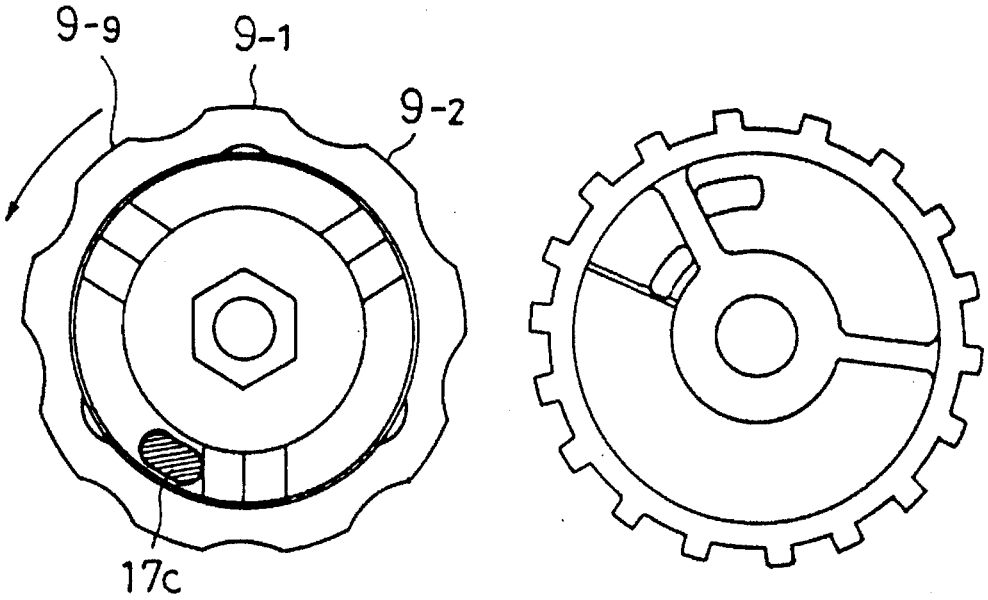
FIGS. 26*a* and 26*b*, collectively referred to as FIG. 26, are a front view showing a different embodiment modifying a part of FIG. 10.
Figure 26B:
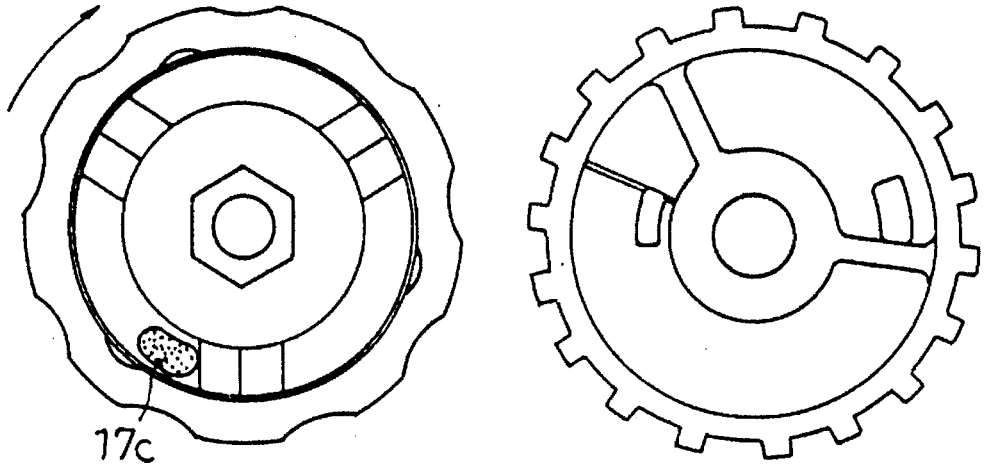
Figure 27:
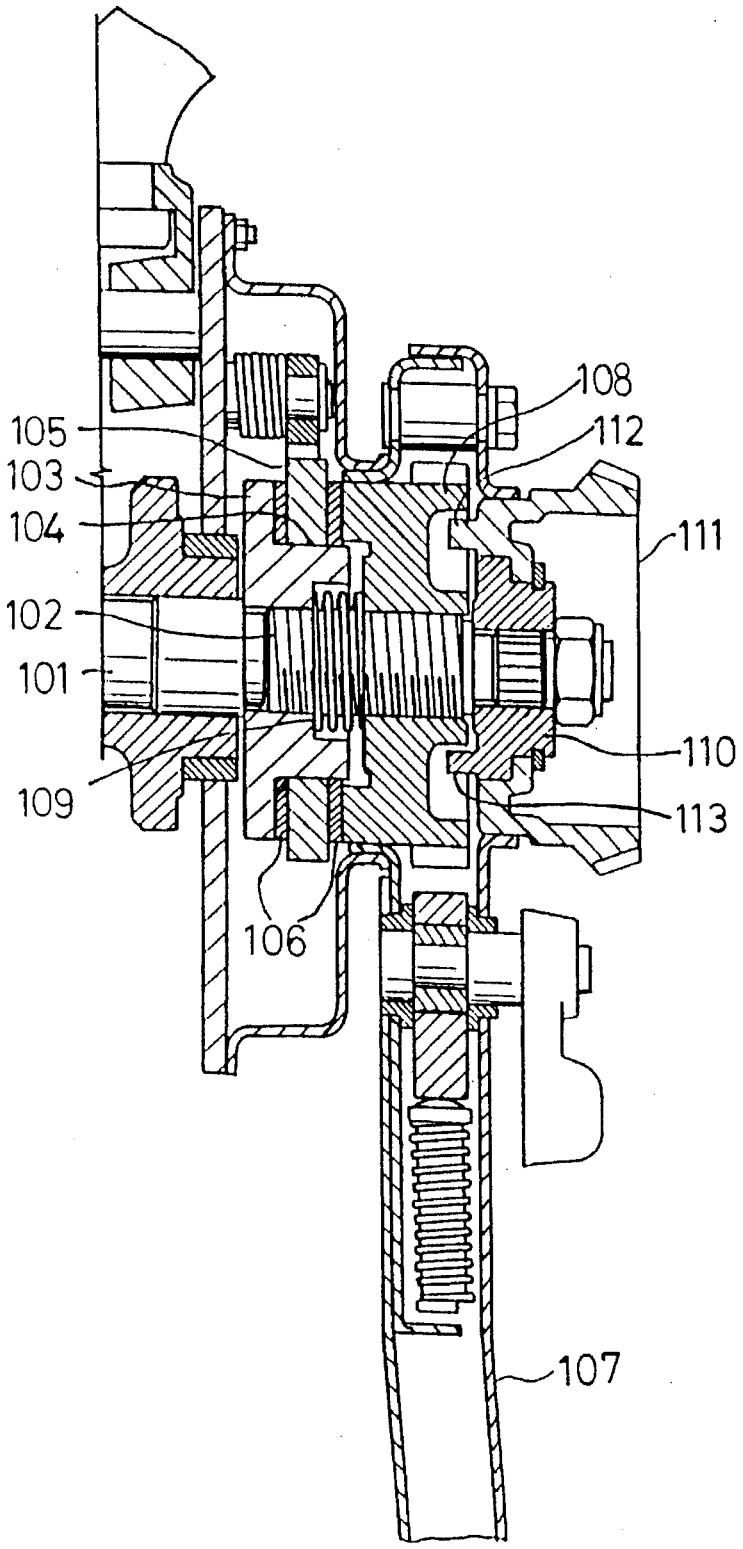
Fig. 27 PRIOR ART
FIG. 27 is a longitudinal sectional view of essential parts in the prior art.

FIG. 26 shows a further different embodiment, in which the idling holding plate 18, spring retainer 17, and operation wheel 16 are different from those in the apparatus shown in FIG. 10. That is, nine projections 9-1 to 9-9 are formed on the outer circumference of the operation wheel 16, and an opening window 17C is formed in the spring retainer 17. In the idling holding plate 18, red and green colored portions are formed, and when the operation wheel 16 is rotated, the red or green colored portion is visible through the opening window 17C.

In FIG. 26(*a*), the operation wheel 16 is rotated in the counterclockwise direction to set the lever type hoist in idling state, and the red color is visible through the opening window 17C, so that it is easy to recognize that the lever type hoist is in idling state. In FIG. 26(*b*), on the other hand, the green color is visible through the opening window 17C, which can be clearly distinguished from the state in FIG. 26(*a*).

What is claimed is:

1. A lever type hoist comprising:

a load sheave having an outer side in the axial direction;

a drive shaft inserted in said load sheave, said drive shaft having an outer side in the axial direction;

a gear train coupling said drive shaft with said load sheave;

a pressure bearing member disposed adjacent to said outer side of said load sheave, said pressure bearing member being fixed on said drive shaft and having an end surface in the axial direction;

a pressing drive member screwed onto said outer side of said drive shaft opposite to said end surface of said pressure bearing member, for engagement with an operation lever, said pressing drive member having an outer side in the axial direction;

a reverse rotation preventive wheel interposed between said pressure bearing member and said pressing drive member, said reverse rotation preventive wheel being disposed rotatably in one direction only about said drive shaft and having first and second side surfaces;

first and second friction members disposed on said first and second side surfaces, respectively, of said reverse rotation preventive wheel, and disposed so as to be pressed by said pressing drive member;

a rotation limiting member disposed adjacent to said outer side of said pressing drive member, said rotation limiting member being spline-coupled to said drive shaft and having an outer side in the axial direction;

an operation wheel abutting said outer side of said rotation limiting member for rotation about said drive shaft;

thrusting means for thrusting said operation wheel against said rotation limiting member, wherein said thrusting means comprises a spring retainer fixed at said outer side of said rotation limiting member and a compression spring interposed between said spring retainer and said operation wheel;

engaging means for engaging a part of said pressing drive member, said engaging means being disposed on said operation wheel at a position facing said pressing drive member; and engaged means for engagement by said engaging means, said engaged means being disposed on said pressing drive member at a position facing said operation wheel.

2. The lever type hoist of claim 1, further comprising an idling holding plate rotating together with said operation wheel, said idling holding plate being interposed between said spring retainer and said compression spring.

3. The lever type hoist of claim 2, further comprising engagement means for providing engagement between said spring retainer and said idling holding plate, said engagement means having an engaged state and a cleared state and being configured to easily move from said engaged state to said cleared state.

4. The lever type hoist of claim 3, wherein said engagement means comprises concave and convex parts formed respectively in said spring retainer and said idling holding plate.

5. The lever type hoist of claim 1, further comprising an idling holding plate rotating together with said rotation limiting member, said idling holding plate being fitted on said rotation limiting member and interposed between said spring retainer and said operation wheel.

6. The lever type hoist of claim 5, further comprising engagement means for providing engagement between said operation wheel and said idling holding plate, said engagement means having an engaged state and a cleared state and being configured to easily move from said engaged state to said cleared state.

7. The lever type hoist of claim 1, wherein said spring retainer comprises a disk having a central part and a peripheral edge, a protrusion at said central part forming a central bump, and a flange formed at said peripheral edge around said central bump;

wherein said drive shaft penetrates and is fixed in said central bump; and wherein said compression spring is held by said flange.

8. The lever type hoist of claim 7, wherein said operation wheel has an outer side in the axial direction and a central recess formed in said outer side of said operation wheel, said recess having a bottom wall, and said bottom wall having inner and outer sides in the axial direction;

wherein said inner side of said bottom wall abuts on said outer side of said rotation limiting member; and wherein said compression spring is interposed between said outer side of said bottom wall and said flange of said spring retainer.

9. The lever type hoist of claim 8, wherein said outer side of said rotation limiting member has an outer circumference and a step formed in said outer circumference; and wherein said inner and outer sides of said bottom wall of said operation wheel are enclosed between said inner surface of said central bump and said step.

10. The lever type hoist of claim 1, wherein said engaging means comprises a pressing release projection protruding from said operation wheel at a position facing said pressing drive member; and wherein said engaged means comprises radial projections protruding from said pressing drive member at positions facing said operation wheel.

11. The lever type hoist of claim 10, wherein said end surface of said pressing drive member includes an annular space, and a first projection and a second projection extending across said annular space in the radial direction facing said operation wheel, said first projection and said second projection dividing said annular space into first and second sector spaces; and wherein said pressing release projection protrudes into one of said first and second sector spaces.

12. The lever type hoist of claim 11, wherein said rotation limiting member includes a rotation limiting projection protruding therefrom at a position facing said pressing drive member; and wherein said rotation limiting projection protrudes into the other of said first and second sector spaces.

13. The lever type hoist of claim 1, wherein said engaging means comprises a recess formed in said operation wheel at a position facing said pressing drive member; and wherein said engaged means comprises a bump formed in said pressing drive member at a position facing said operation wheel.

14. A lever type hoist comprising:

a load sheave having an outer side in the axial direction;

a drive shaft inserted in said load sheave, said drive shaft having a threaded part;

a gear train coupling said drive shaft with said load sheave;

a pressure bearing member disposed adjacent to said outer side of said load sheave, said pressure bearing member being fixed on said drive shaft and having an outer side in the axial direction, an end face at said outer side, and a boss formed at said outer side adjacent said end face, said boss having an outer circumference;

a reverse rotation preventive wheel disposed on said outer circumference of said boss, said reverse rotation preventive wheel being rotatable in one direction only and having first and second sides;

first and second friction members disposed respectively on said first and second sides of said reverse rotation preventive wheel;

a pressing drive member retractably screwed onto said threaded part of said drive shaft facing said end face of said outer side of said pressure bearing member, said pressing drive member having an outer side in the axial direction and being rotatable in a hoisting direction and a lowering direction, said reverse rotation preventive wheel and said first and second friction members being interposed between said pressing drive member and said pressure bearing member, and said end surface of said pressing drive member including an annular space, and a first projection and a second projection extending across said annular space in the radial direction facing said operation wheel, said first projection and said second projection dividing said annular space into first and second sector spaces;

an operation lever for rotating said pressing drive member in said hoisting and lowering directions;

a rotation limiting member disposed adjacent to said outer side of said pressing drive member and being spline-coupled to said drive shaft, said rotation limiting member having inner and outer end surfaces in the axial direction, an outer circumference, a step formed in said outer circumference adjacent said outer end surface of said rotation limiting member, and a rotation limiting projection formed in said inner end surface of said pressing drive member and protruding at a position opposite said pressing drive member into one of said first and second sector spaces;

an operation wheel abutting said outer circumferential step of said rotation limiting member and rotatable on said drive shaft, said operation wheel having an inner end surface and an outer surface in the axial direction, and a pressing release projection formed in said inner end surface of said operation wheel and protruding into the other of said first and second sector spaces;

a spring retainer fixed on said drive shaft and projecting from said outer side of said rotation limiting member; and a compression spring interposed between said spring retainer and said outer surface of said operation wheel, said compression spring thrusting said operation wheel against said pressing drive member.

* * * * *